US008123289B2

(12) United States Patent
Qiu et al.

(10) Patent No.: US 8,123,289 B2
(45) Date of Patent: Feb. 28, 2012

(54) LIFT CHAIR AND A CHAIR FRAME WITH A POSITION HOLDING MECHANISM FOR USE THEREWITH

(75) Inventors: Jian-Ming Qiu, Shanghai (CN); Yan-Jun Zhang, Shanghai (CN); Zhi-Liang Gao, Shanghai (CN); Xiao-Xiang Zhang, Shanghai (CN)

(73) Assignee: I-Trust Better Life Corp, Buena Park, CA (US)

( * ) Notice: Subject to any disclaimer, the term of this patent is extended or adjusted under 35 U.S.C. 154(b) by 338 days.

(21) Appl. No.: 12/565,252

(22) Filed: Sep. 23, 2009

(65) Prior Publication Data

US 2010/0072805 A1 Mar. 25, 2010

Related U.S. Application Data

(60) Provisional application No. 61/099,571, filed on Sep. 24, 2008.

(51) Int. Cl.
*A47C 1/031* (2006.01)

(52) U.S. Cl. ..... 297/85 R; 297/68

(58) Field of Classification Search ..... 297/83, 297/84, 85 R, 463.1, 68; 74/531
See application file for complete search history.

(56) References Cited

U.S. PATENT DOCUMENTS 3,121,589 A * 2/1964 Schliephacke ..... 297/84
3,393,007 A * 7/1968 Fletcher ..... 297/85 R
5,348,367 A * 9/1994 Mizelle ..... 297/83

* cited by examiner

*Primary Examiner* — Milton Nelson, Jr.
(74) *Attorney, Agent, or Firm* — Morris Manning & Martin LLP; Tim Tingkang Xia, Esq.

(57) ABSTRACT

In one aspect, the present invention relates a reclining lift chair frame used in a reclining lift chair. The reclining lift chair frame utilizes a position holding mechanism to eliminate the free (idle) fall of the footrest of the reclining lift chair.

13 Claims, 9 Drawing Sheets

LIFT CHAIR AND A CHAIR FRAME WITH A POSITION HOLDING MECHANISM FOR USE THEREWITH

CROSS-REFERENCE TO RELATED PATENT APPLICATION

This application claims priority to and the benefit of, pursuant to 35 U.S.C. §119(e), U.S. provisional patent application Ser. No. 61/099,571, filed Sep. 24, 2008, entitled "THREE-WAY RECLINING MECHANISMS WITH STOP-PIN AND ROLLER WORKING IN CONJUNCTION WITH MECHANISMS LINKAGE TO ELIMINATE FREE FALL," by Jian-Ming QIU, Yan-Jun ZHANG, Zhi-Liang GAO, and Xiao-Xiang ZHANG, the content of which is incorporated herein in its entirety by reference.

Some references, which may include patents, patent applications and various publications, are cited in a reference list and discussed in the description of this invention. The citation and/or discussion of such references is provided merely to clarify the description of the present invention and is not an admission that any such reference is "currently available" to the invention described herein. All references cited and discussed in this specification are incorporated herein by reference in their entireties and to the same extent as if each reference was individually incorporated by reference.

FIELD OF THE INVENTION

The present invention generally relates to a lift chair, and more particular to a reclining lift chair frame used in a reclining lift chair. The reclining lift chair frame utilizes a position holding mechanism to eliminate the free (or idle) fall of the footrest of the reclining lift chair.

BACKGROUND OF THE INVENTION

Reclining lift chairs find widespread use. A reclining chair usually has a seat, backrest and footrest operable with three-way reclining mechanisms among three positions, a fully upright position, a TV position and a fully reclined position. In the TV position, the seat and backrest are partially reclined and the footrest extended, while in the fully reclined position, the seat and backrest are fully reclined and the footrest extended.

FIG. 10 shows a reclining chair frame having the three-way reclining mechanisms. The three-way reclining mechanism assembly utilizes a conventional L-shaped position holding member 1 to hold a desired position among the fully upright position, the TV position and the fully reclined position. The conventional L-shaped position holding member 1 is pivotally connected to a seat link 2, an end of a stop link 3 and an end of a brace link 4, respectively. The stop link 3 and the brace link 4, in turn, are pivotally connected to a base mounting plate 5 by the other ends. For such a design, however, it has been found that when the lift chair is in the full recline position, an unintended falling of the footrest 7 may occur when the footrest 7 is idle, i.e., no force applied thereto, or when a force, F, is applied thereto. The unintended falling is unsatisfactory in terms of the comfort it provide for the occupant.

Therefore, a heretofore unaddressed need exists in the art to address the aforementioned deficiencies and inadequacies.

SUMMARY OF THE INVENTION

The present invention, in one aspect, relates to a position holding mechanism used in a reclining lift chair having an upright position, a TV position and a fully reclined position.

In one embodiment, the position holding mechanism includes a position holding member having a triangle-shaped body and an arm extending from an apex of the triangle-shaped body, where the triangle-shaped body has a first side and a second side extending to the arm, a bottom extending to the first and second sides, a notched receptacle recessed from the first side proximal to the apex and an obround opening defined proximally along the second side; and where the arm has two openings defined in each end portion.

The position holding mechanism also includes a detent pin assembly having a stable spacer, a roller bushing received in the stable spacer, and a detent pin received in the roller bushing such that as assembled, the stable spacer is rotatable relative to the detent pin.

The position holding member is movably positioned in relation to the detent pin assembly such that when the reclining lift chair is in the upright position, the detent pin assembly is received in the notched receptacle of the position holding member, and when the reclining lift chair is in the fully reclined position, the detent pin assembly is against the first side of the position holding member.

In another aspect, the present invention relates to a reclining lift chair comprising the position holding mechanism as disclosed above.

In yet another aspect, the present invention relates to a reclining lift chair frame used in a reclining lift chair having an upright position, a TV position, and a fully reclined position. In one embodiment, the reclining lift chair frame includes a base mounting plate, a seat mounting link positioned movably relative to the base mounting plate, a footrest driving mechanism pivotally connected between the base mounting plate and the seat mounting link, a footrest linkage pivotally connected to the footrest driving mechanism and the seat mounting link, where the footrest linkage is operably driven by the footrest driving mechanism between a retracted position and an extended position, a backrest linkage pivotally connected to the seat mounting link and the base mounting plate, a rear drive linkage pivotally connected to the base mounting plate and the footrest driving mechanism, for driving the backrest linkage and the footrest driving mechanism to be in a desired position that is corresponding to one of the upright position, the TV position, and the fully reclined position of the reclining lift chair, and a position holding mechanism.

The position holding mechanism has a position holding member having a triangle-shaped body and an arm extending from an apex of the triangle-shaped body, where the triangle-shaped body has a first side and a second side extending to the arm, a bottom extending to the first and second sides, a notched receptacle recessed from the first side proximal to the apex and an obround opening defined proximally along the second side; where the arm has a first opening defined in free end portion and a second opening defined in the end portion proximal to the apex, and where the position holding member is pivotally connected to the seat mounting link through the first opening and to the rear drive linkage through the second opening, respectively, and a detent pin assembly mounted onto the base mounting plate, and having a stable spacer, a roller bushing received in the stable spacer, and a detent pin received in the roller bushing such that the stable spacer is rotatable relative to the detent pin, where the position holding member is movably positioned in relation to the detent pin assembly such that when the reclining lift chair is in the upright position, the detent pin assembly is received in the notched receptacle of the position holding member, and when the reclining lift chair is in the fully reclined position, the detent pin assembly is against the first side of the position holding member.

In one embodiment, the footrest linkage has a scissor-type linkage.

In one embodiment, the footrest linkage has a first front link, a second front link, a first rear link, a second rear link and a footrest mounting bracket, each link having a first end portion and a second end, where the first end portions of the first and second front links are pivotally connected to the footrest mounting bracket, and the second end portions of the first and second front links are pivotally connected to the first end portions of the first and second rear links, respectively, where the second front link is pivotally connected to the first rear link, and where the second end portion of the first rear link is pivotally connected to a front end portion of the seat mounting link.

The footrest driving mechanism comprises a front link, a rear link and a drive link, each link having a first end portion and a second end, where the first end portion of the front link is pivotally connected to the first rear link of the footrest linkage, the first end portion of the drive link is pivotally connected to the seat mounting link, the second end portion of the rear link is pivotally connected to the base mounting plate, and where the second end portions of the front and drive links, the first end portion of the rear link and the second end portion of the second rear link of the footrest linkage are pivotally connected together.

The rear drive linkage comprises a stop link, a brace link and a connection link, each link having a first end portion and a second end, where the first end portion of the stop link is pivotally connected to the position holding member of the position holding mechanism through the second opening, and the second end portion of the stop link is pivotally connected to the base mounting plate, where the first end portion of the connection link is pivotally connected to the second end portion of the rear link of the footrest driving mechanism, and the second end portion of the connection link is pivotally connected to the second end portion of the stop link, and where the first end portion of the brace link is pivotally connected to the position holding member of the position holding mechanism through the obround opening, and the second end portion of the brace link is pivotally connected to the base mounting plate. The brace link is operably movable back and forth along the obround opening of the position holding member of the position holding mechanism.

The backrest linkage comprises a backrest link having a first end portion and a second end portion pivotally connected to the base mounting plate, and a backrest mounting bracket pivotally connected to the second end portion of the backrest link and a rear end portion of the seat mounting link.

In one embodiment, when the base mounting plate moves, relative to the seat mounting link, to a most rearward position, the footrest linkage is in the retracted position, the detent pin assembly is received in the notched receptacle of the position holding member of the position holding mechanism, and the backrest mounting bracket and the seat mounting link define a first angle therebetween, which corresponds to a position in which the reclining chair is in the upright position.

When the base mounting plate moves, relative to the seat mounting link, to a most forward position, the footrest linkage is in the extended position, the detent pin assembly is positioned against the first side of the position holding member of the position holding mechanism, and the backrest mounting bracket and the seat mounting link define a second angle therebetween, where the second angle is greater then the first angle, which corresponds to a position in which the reclining chair is in the fully reclined position.

When the base mounting plate moves to a desired position between the most rearward and forward positions, the footrest linkage is in the extended position, and the seat mounting link define a third angle therebetween, where the third angle is greater then the first angle but less than the second angle, which corresponds to a position in which the reclining chair is in the fully reclined position.

In a further aspect, the present invention relates to a reclining lift chair comprising the reclining lift chair frame as disclosed above.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
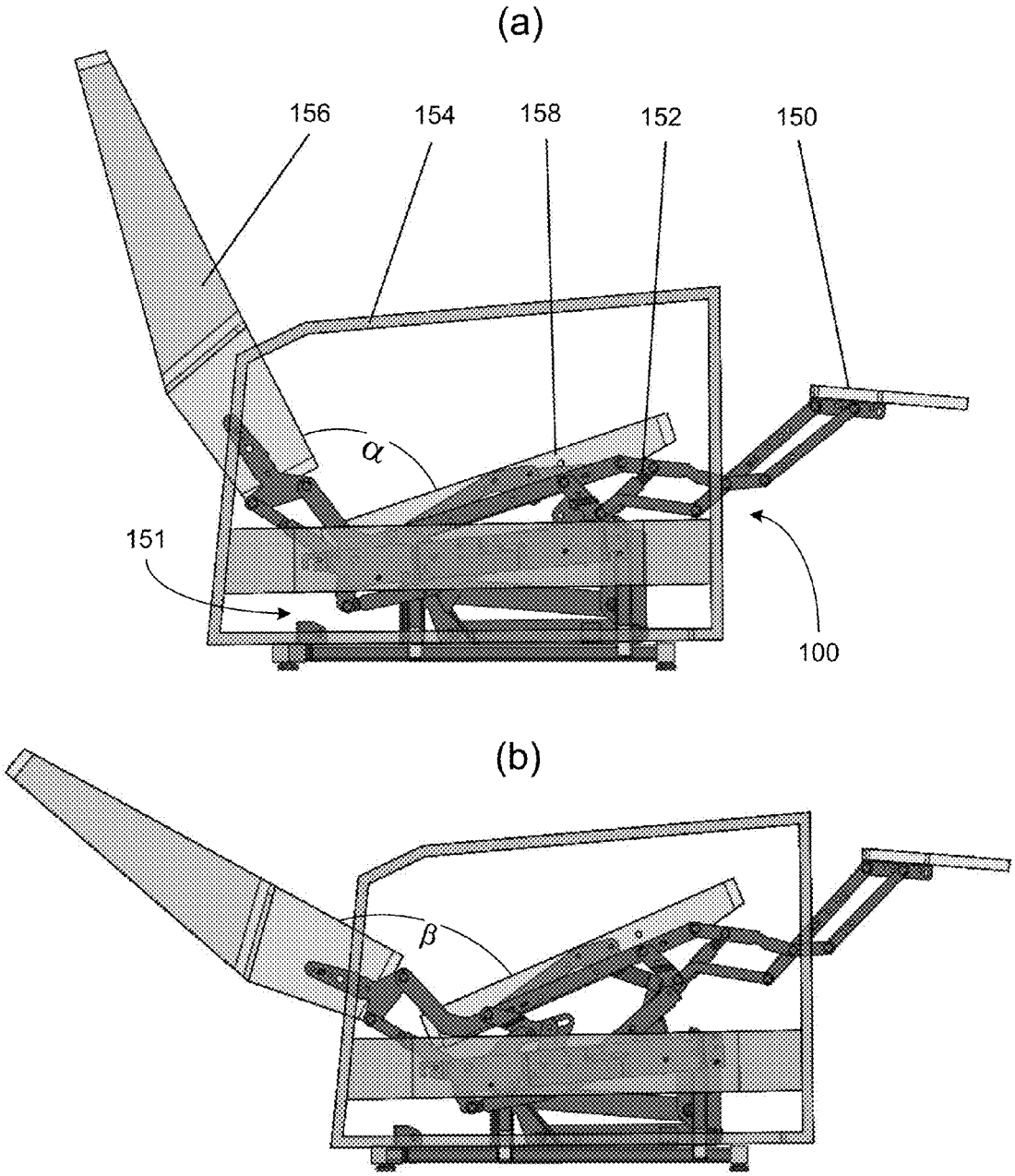
FIG. 1 shows schematically a side view of a reclining lift chair having left and right chair frames according to one embodiment of the present invention, (a) in a TV position, and (b) in a fully declined position.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to a position holding mechanism and a reclining lift chair frame that are used in a reclining lift chair having an upright position, a TV position and a fully reclined position.

Referring first to FIG. 1, a reclining lift chair or sofa is schematically shown according to one embodiment of the present invention. The reclining lift chair includes a chair base 151 placed on a floor, a reclining lift chair frame 100 mounted on a chair base 151, a backrest 156, a seat 158 and a footrest 150 supported by the reclining lift chair frame 100. The reclining lift chair also has an armrest mounted onto the chair base 151. The reclining lift chair frame 100 has a scissor-type footrest linkage 152 that is operably in a retracted position or an extended position. The reclining lift chair frame 100 is configured such that the seat, backrest and footrest are movable among an upright, a semi-reclined or TV position and a fully reclined position. In the TV position, the scissor-type footrest linkage 152 is in the extended position and the backrest and the seat define an angle, $\alpha$, as shown in FIG. 1(*a*). In the fully reclined position, the scissor-type footrest linkage 152 is in the extended position and the backrest and the seat define an angle, $\beta$, where $\beta>\alpha$, as shown in FIG. 1(*b*).

Figure 2:
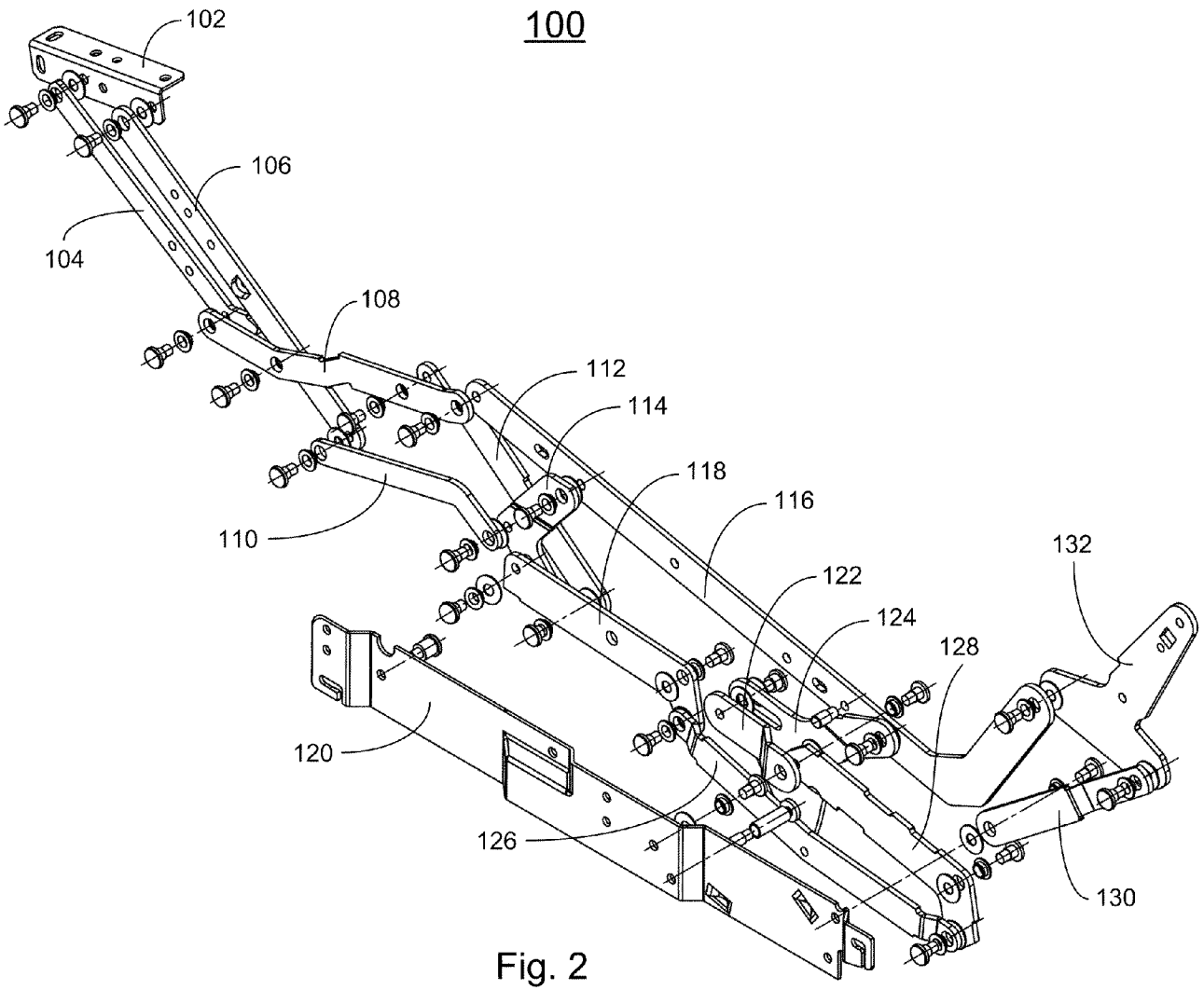
FIG. 2 shows an exploding view of the left chair frame shown in FIG. 1.
Figure 3:
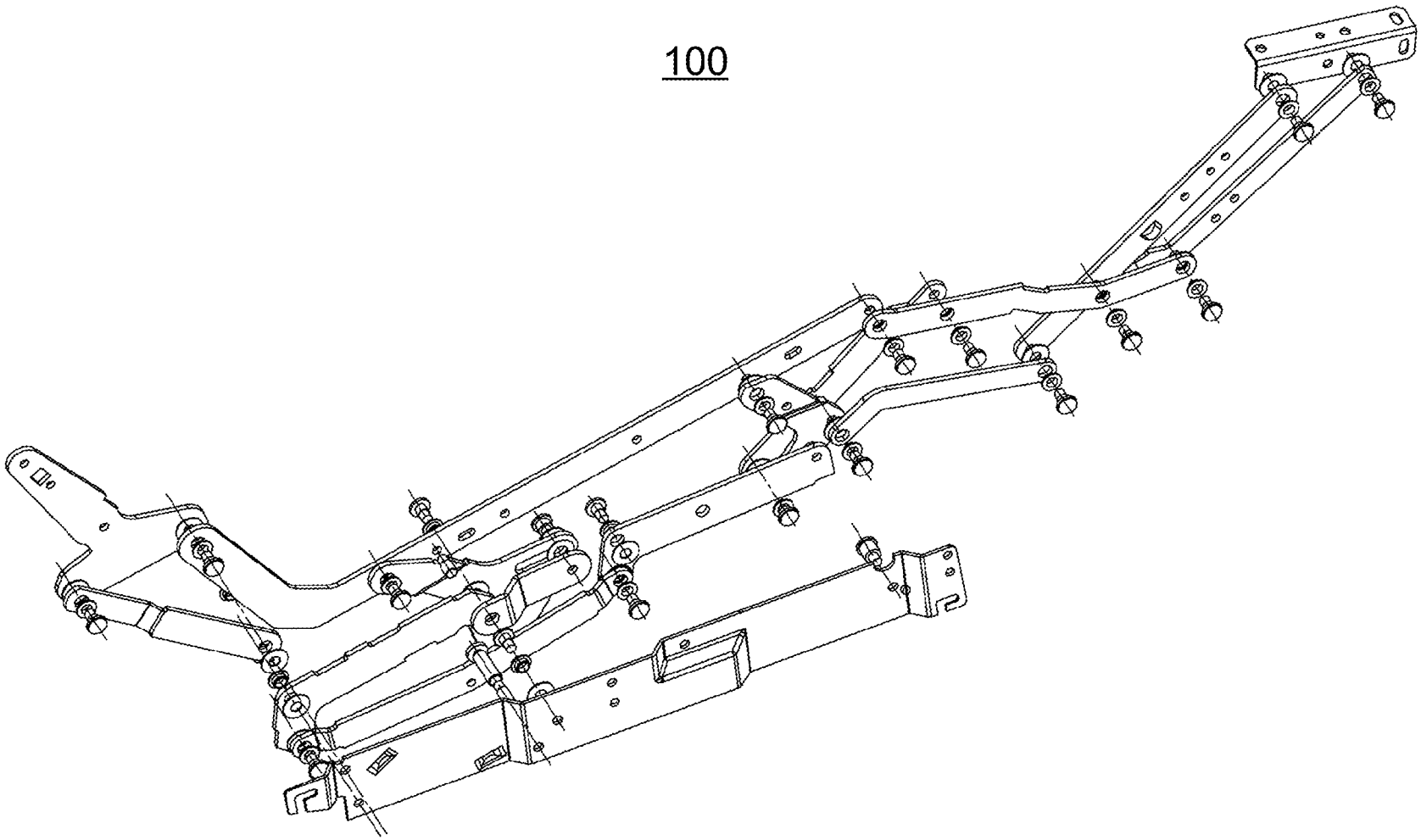
FIG. 3 shows an exploding view of the right chair frame shown in FIG. 1.
Figure 4:
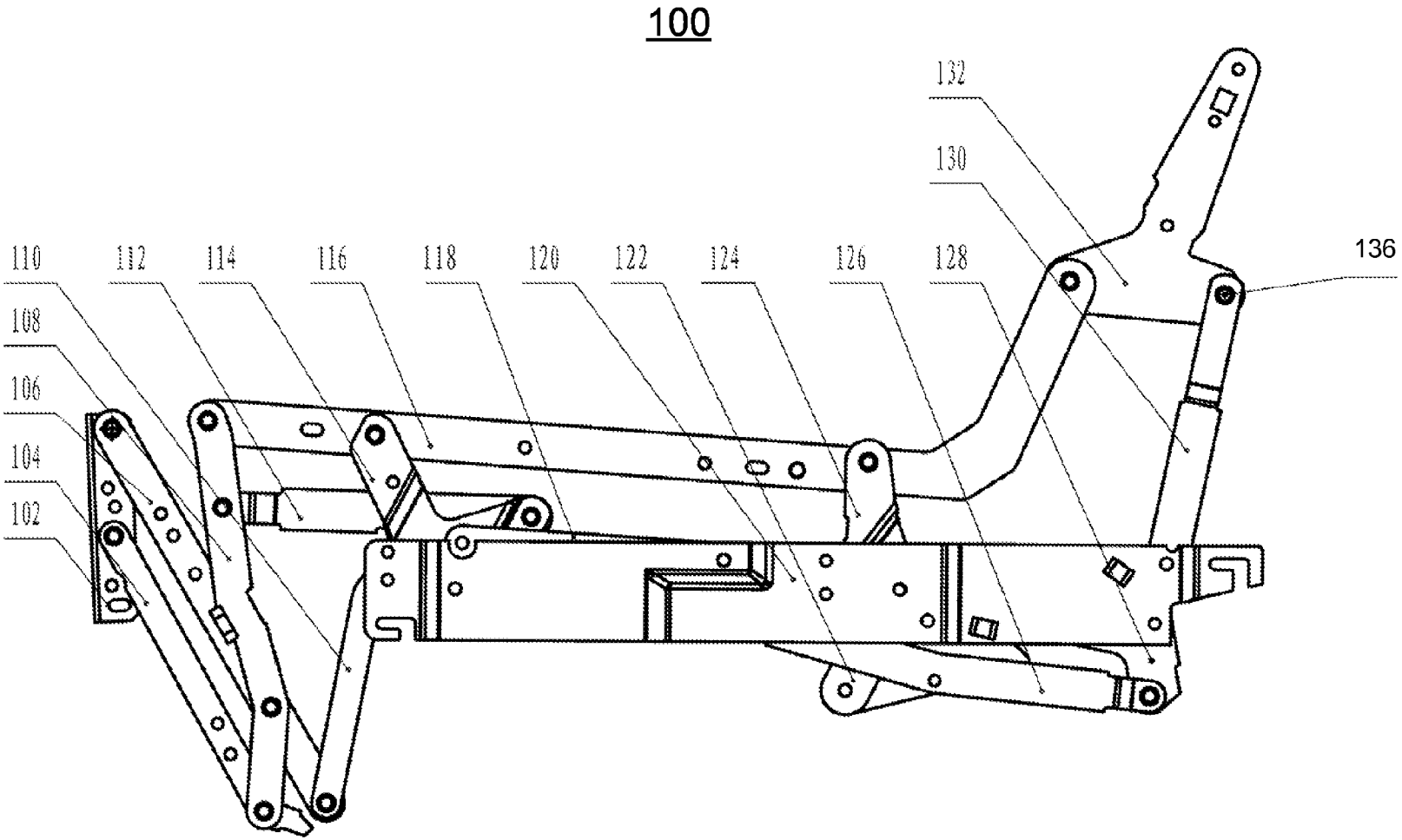
FIG. 4 shows a side view of the left chair frame.
Figure 5:
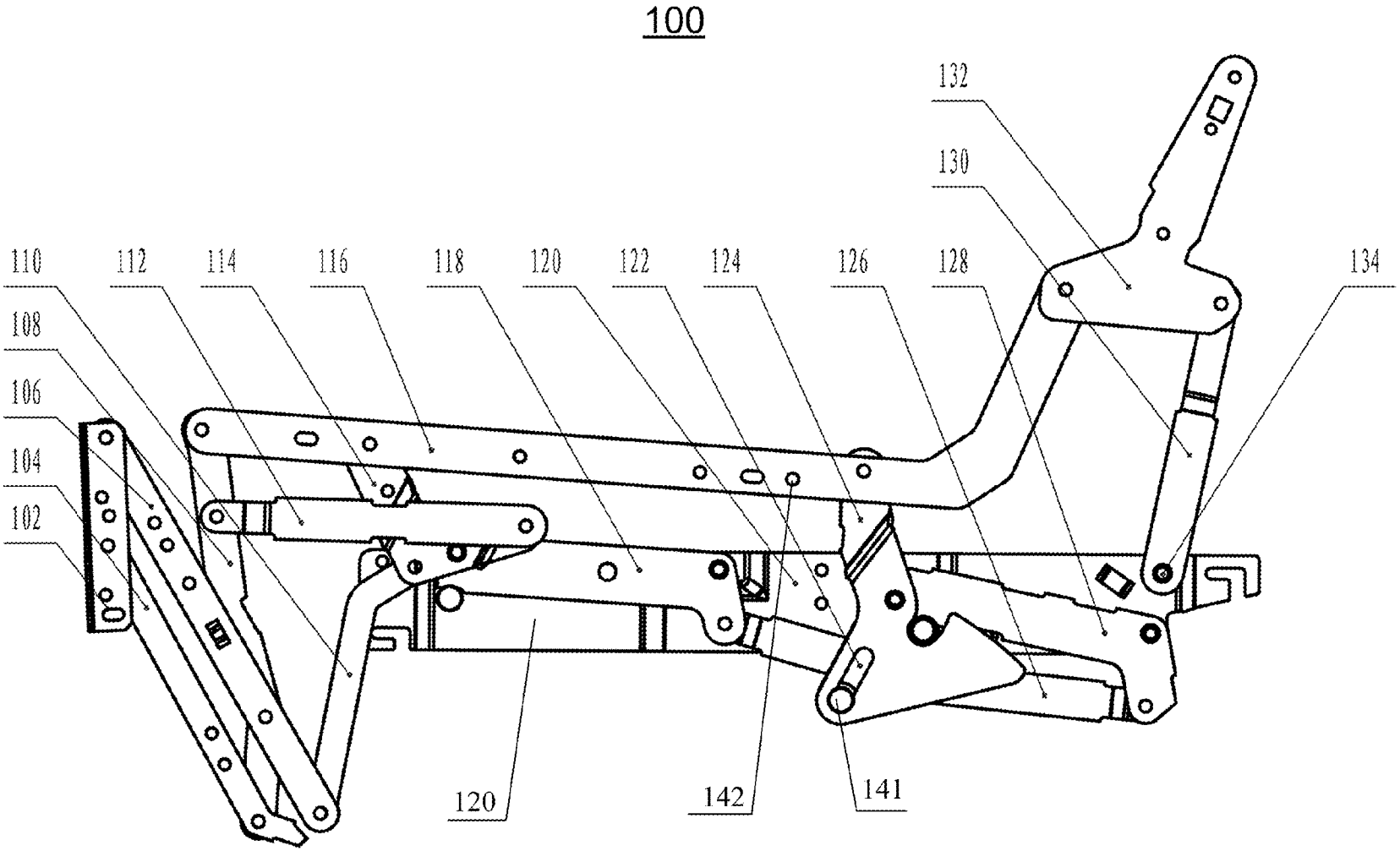
FIG. 5 shows a side view of the right chair frame.

One of the objectives of the present invention is to provide the reclining lift chair frame 100 that eliminates the free (or idle) fall of the footrest 10 when the reclining lift chair is in the fully reclined position. To accomplish this, a position holding mechanism is utilized in the reclining lift chair frame 100. Actually, the reclining lift chair shown in FIG. 1 includes two chair frames 100 located on opposite sides of the reclining lift chair and interconnected by appropriate cross pieces, as necessary. Since the two chair frames 100 on either side of the reclining lift chair are substantially identical and mirror images of one another, as shown in FIG. 2 for the left-hand side chair frame and FIG. 3 for the right-hand side chair frame, only one reclining lift chair frame 100 is described herein for the purposes of simplicity.

Figure 6:
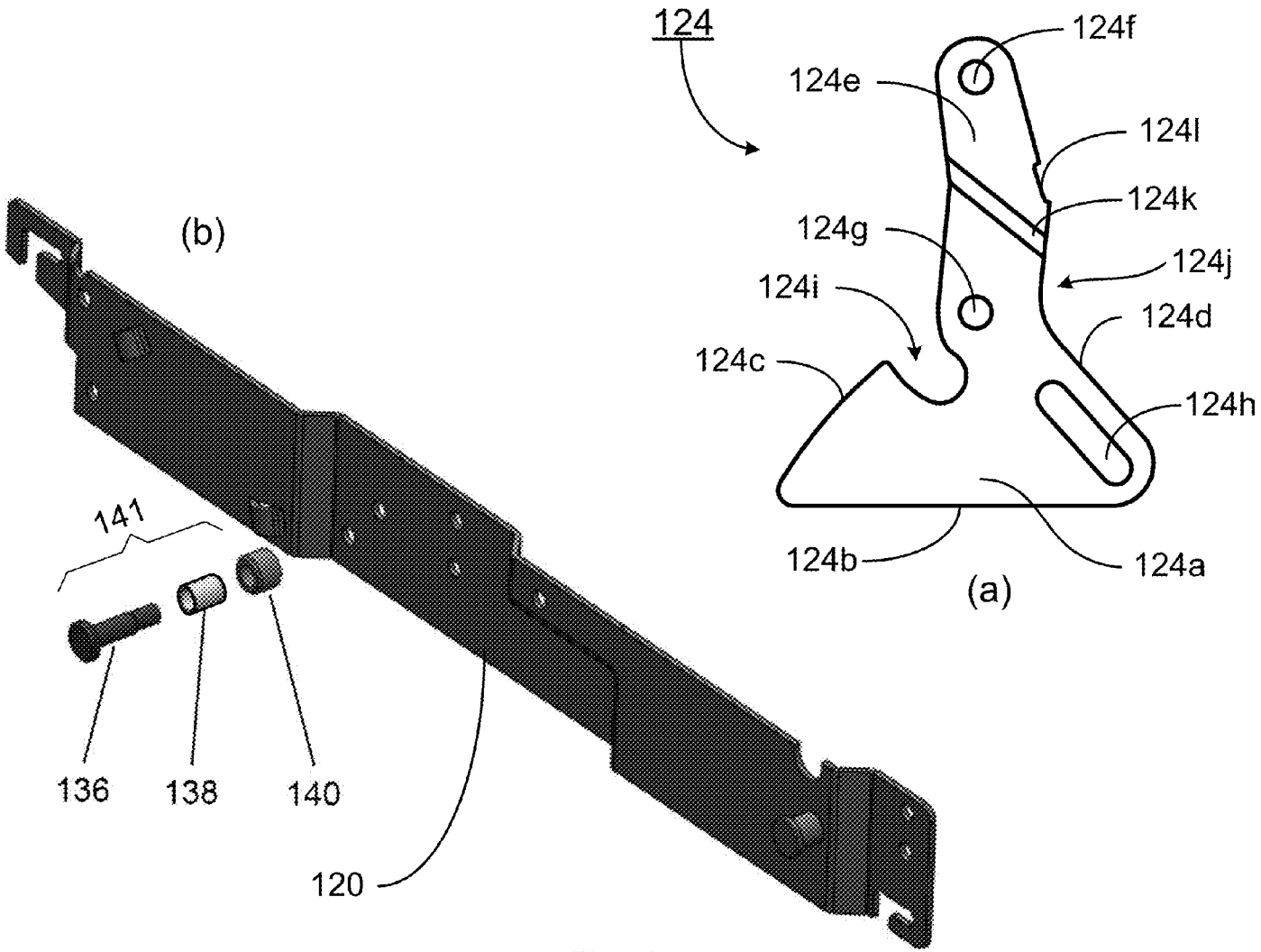
FIG. 6 shows (a) an exploding view of a detent pin assembly, and (b) a side view of a position holding member according to one embodiment of the present invention.

Referring to FIGS. 2-9, and particularly to FIG. 6, the position holding mechanism is shown according to one embodiment of the present invention. The position holding mechanism includes a position holding member 124 and detent pin assembly 141 mounted onto a base mounting plate 120.

The position holding member 124 has a triangle-shaped body 124*a* and an arm 124*e* extending from an apex 124*j* of the triangle-shaped body 124*a*. The triangle-shaped body 124*a* has a first side 124*c* and a second side 124*d* extending to the arm 124*e*, a bottom 124*b* extending to the first and second sides 124*c* and 124*d*, a notched receptacle 124*i* recessed from the first side 124*c* proximal to the apex 124*j* and an obround opening 124*h* defined proximally along the second side 124*d*. The arm 124*e* has two openings 124*f* and 124*g* defined in each end portion. Additionally, the arm 124*e* also has a rib 124*k* formed on a surface and a notch 124*l* formed on one side.

The detent pin assembly 141 has a stable spacer 140, a roller bushing 138 received in the stable spacer 140, and a detent pin 136 received in the roller bushing 138 such that as assembled, the stable spacer 140 is rotatable relative to the detent pin 136.

Figure 7:
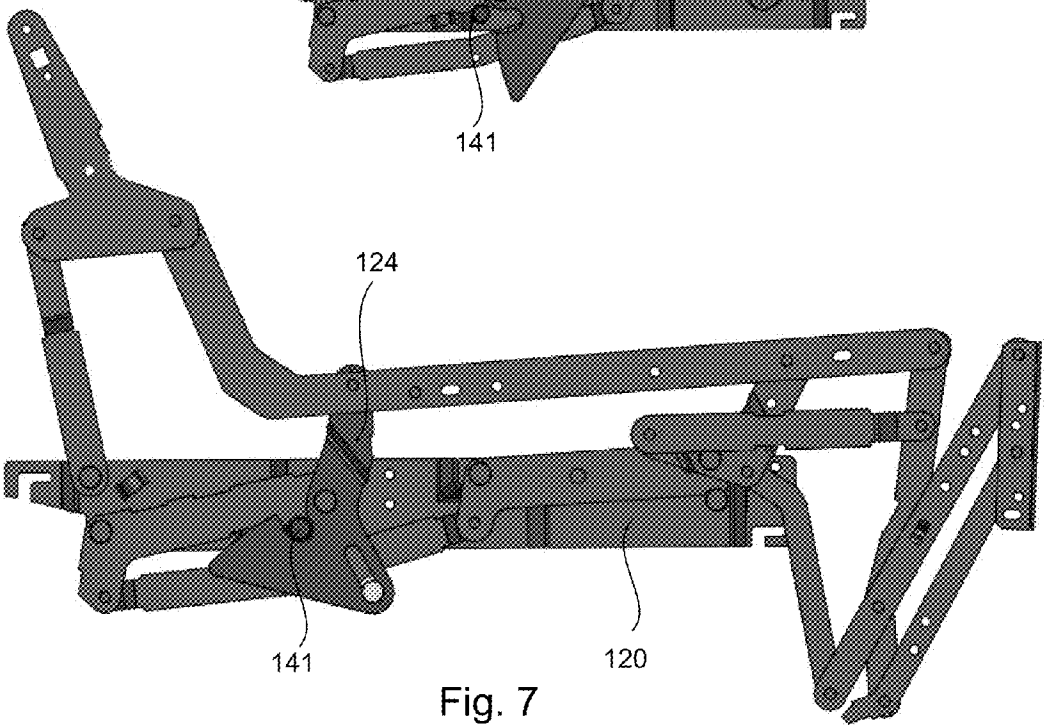
FIG. 7 shows a side view of the left chair frame in an upright position.
Figure 9:
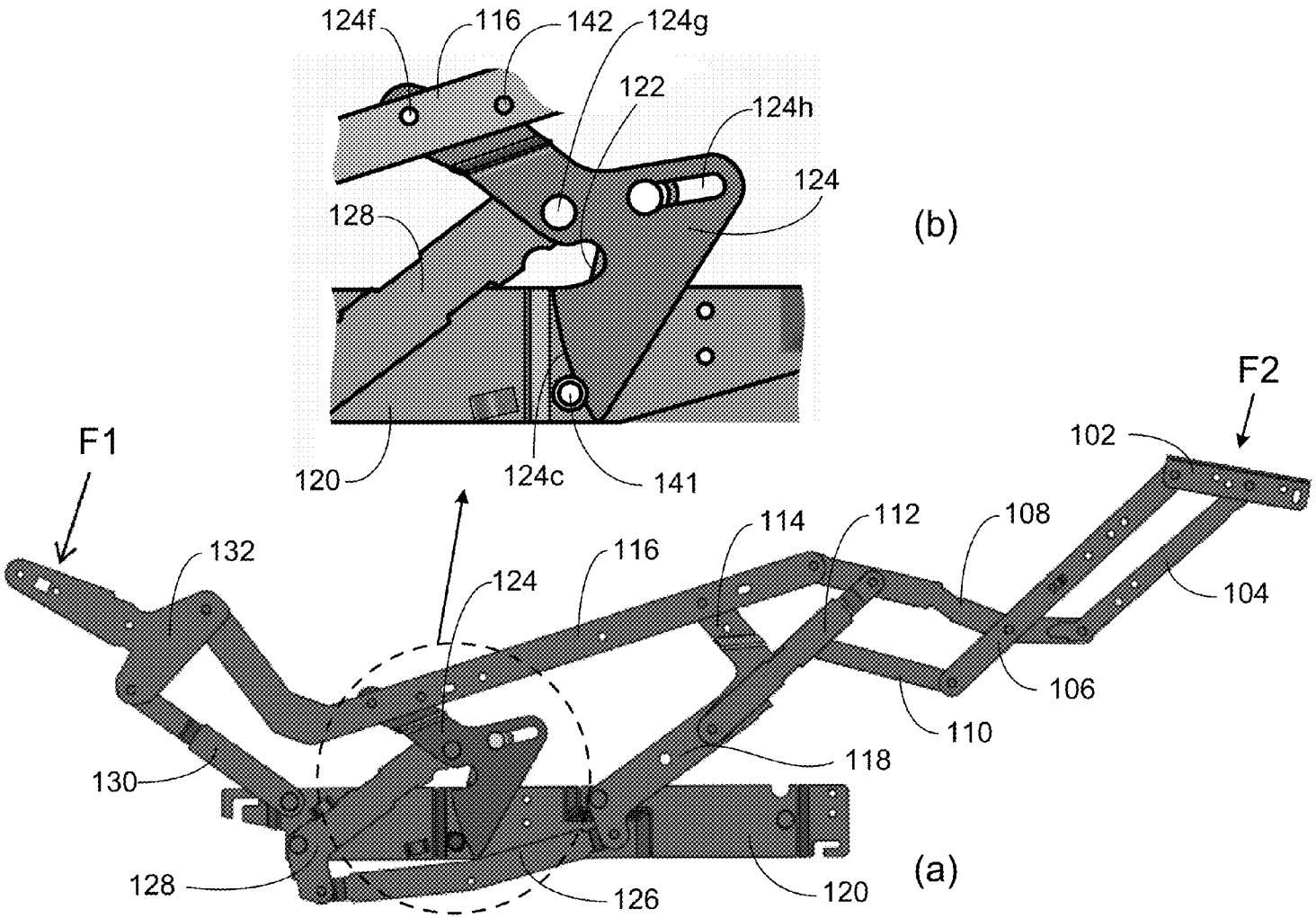
FIG. 9 shows a side view of the left chair frame in the fully declined position, (a) a full side view, and (b) a partial side view.
Figure 10:
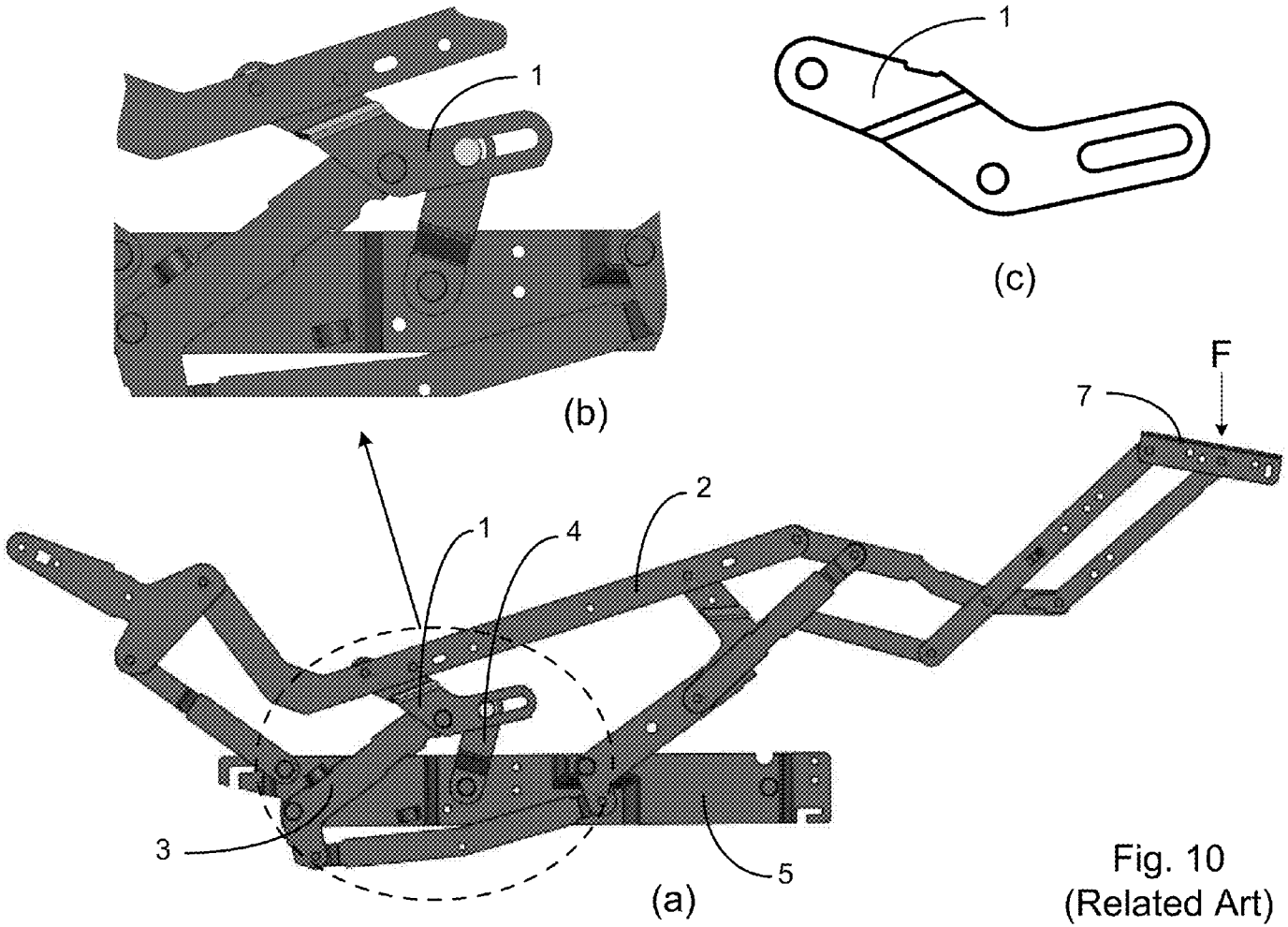
Fig. 10 (Related Art)
FIG. 10 shows a side view of a conventional left chair frame in a fully declined position, (a) a full side view, and (b) a partial side view, and (c) a side view of a conventional L-shaped position holding member.

The position holding member 124 is movably positioned in relation to the detent pin assembly 141 such that when the reclining lift chair is in the upright position, the detent pin assembly 141 is received in the notched receptacle 124*i* of the position holding member 124, as shown in FIG. 7, and when the reclining lift chair is in the fully reclined position, the detent pin assembly 141 is against the first side 124*c* of the position holding member 124, as shown in FIG. 9.

Referring to FIGS. 2-9, the reclining lift chair frame 100 is shown according to one embodiment of the present invention. The reclining lift chair frame 120 includes a base mounting plate 120 for mounting the chair frame 100 onto a chair base (not shown), and a seat mounting link 116 positioned movably relative to the base mounting plate 120, The reclining lift chair frame 100 also includes a footrest driving mechanism pivotally connected between the base mounting plate 120 and the seat mounting link 116, a footrest linkage pivotally connected to the footrest driving mechanism and the seat mounting link 116. The footrest linkage is operably driven by the footrest driving mechanism between a retracted position and an extended position.

The reclining lift chair frame 100 further includes a backrest linkage pivotally connected to the seat mounting link 116 and the base mounting plate 120, a rear drive linkage pivotally connected to the base mounting plate 120 and the footrest driving mechanism, for driving the backrest linkage and the footrest driving mechanism to be in a desired position that is corresponding to one of the upright position, the TV position, and the fully reclined position of the reclining lift chair, and a position holding mechanism.

The footrest linkage has a scissor-type linkage. The footrest linkage has a first front link 104, a second front link 106, a first rear link 108, a second rear link 110 and a footrest mounting bracket 102, with each link having a first end portion and a second end portion. The first end portions of the first and second front links 104 and 106 are spatially and pivotally connected to the footrest mounting bracket 102, and the second end portions of the first and second front links 104 and 106 are pivotally connected to the first end portions of the first and second rear links 108 and 110, respectively. The second front link 106 is pivotally connected to the first rear link 108 in an intermediate position. The second end portion of the first rear link 108 is pivotally connected to a front end portion of the seat mounting link 116.

The footrest driving mechanism has a front link 112, a rear link 118 and a drive link 114, with each link having a first end portion and a second end. The first end portion of the front link 112 is pivotally connected to the first rear link 108 of the footrest linkage. The first end portion of the drive link 114 is pivotally connected to the seat mounting link 116. The second end portion of the rear link 118 is pivotally connected to the base mounting plate 120. The second end portions of the front and drive links 112 and 118, the first end portion of the rear link 118 and the second end portion of the second rear link 110 of the footrest linkage are pivotally connected together.

The rear drive linkage comprises a stop link 128, a brace link 122 and a connection link 126, with each link having a first end portion and a second end. The first end portion of the stop link 128 is pivotally connected to the position holding member 124 of the position holding mechanism through the second opening 124*g*, and the second end portion of the stop link 128 is pivotally connected to the base mounting plate 120. The first end portion of the connection link 126 is pivotally connected to the second end portion of the rear link 118 of the footrest driving mechanism, and the second end portion of the connection link 126 is pivotally connected to the second end portion of the stop link 128. The first end portion of the brace link 122 is pivotally connected to the position holding member 124 of the position holding mechanism through the obround opening 124*h*, and the second end portion of the brace link 122 is pivotally connected to the base mounting plate 120. For such an arrangement, the brace link 122 is operably movable back and forth along the obround opening 124*h* of the position holding member 124 of the position holding mechanism.

The backrest linkage has a backrest link 130 having a first end portion 134 pivotally connected to the base mounting plate 120 and a second end portion 136, and a backrest mounting bracket 132 pivotally connected to the second end portion 136 of the backrest link 130 and a rear end portion of the seat mounting link 116.

The position holding mechanism includes a position holding member 124 and detent pin assembly 141 mounted onto a base mounting plate 120.

The position holding member 124 has a triangle-shaped body 124*a* and an arm 124*e* extending from an apex 124*j* of the triangle-shaped body 124*a*. The triangle-shaped body 124*a* has a first side 124*c* and a second side 124*d* extending to the arm 124*e*, a bottom 124*b* extending to the first and second sides 124*c* and 124*d*, a notched receptacle 124*i* recessed from the first side 124*c* proximal to the apex 124*j* and an obround opening 124*h* defined proximally along the second side 124*d*. The arm 124*e* has two openings 124*f* and 124*g* defined in each end portion. Additionally, the arm 124*e* also has a rib 124*k* formed on a surface and a notch 124*l* formed on one side. The position holding member 124 is pivotally connected to the seat mounting link 116 through the first opening 124*f* and to the first end portion of the stop link 128 of the rear drive linkage through the second opening 124*g*, respectively.

The detent pin assembly 141 has a stable spacer 140, a roller bushing 138 received in the stable spacer 140, and a detent pin 136 received in the roller bushing 138 such that as assembled, the stable spacer 140 is rotatable relative to the detent pin 136.

For such an arrangement, the base mounting plate 120, the seat mounting link 120, footrest driving mechanism, the footrest linkage, the rear drive linkage and the backrest linkage are operably moveable relative to one another. The movements are achieved usually by an actuator, such as motors or other actuating mechanisms (not shown).

When the base mounting plate 120 moves, relative to the seat mounting link 116, to a most rearward position, the footrest linkage is in the retracted position, the detent pin assembly 141 is received in the notched receptacle 124*i* of the position holding member 124 of the position holding mechanism, and the backrest mounting bracket 132 and the seat mounting link 116 define a first angle therebetween, as shown in FIG. 7. This corresponds to a position in which the reclining chair is in the upright position. According to the present invention, no free fall of the footrest occurs in this position.

When the base mounting plate 120 moves, relative to the seat mounting link 116, to a most forward position, the footrest linkage is in the extended position, the detent pin assembly 141 is positioned against the first side 124*c* of the position holding member 124 of the position holding mechanism, and a small pin 142 mounted on the seat mounting link 116 is positioned against the notch 124*i* of the position holding member 124 of the position holding mechanism, and the backrest mounting bracket 132 and the seat mounting link 116 define a second angle therebetween, where the second angle is greater then the first angle, as shown in FIG. 9. This corresponds to a position in which the reclining chair is in the fully reclined position. In this position, when forces F1 and F2 are respectively applied to the backrest and footrest simultaneously or individually, no free fall of the footrest will occur, since the detent pin assembly 141 is positioned against the first side 124*c* of the position holding member 124 of the position holding mechanism, which holds the extended position of the footrest linkage solidly.

Figure 8:
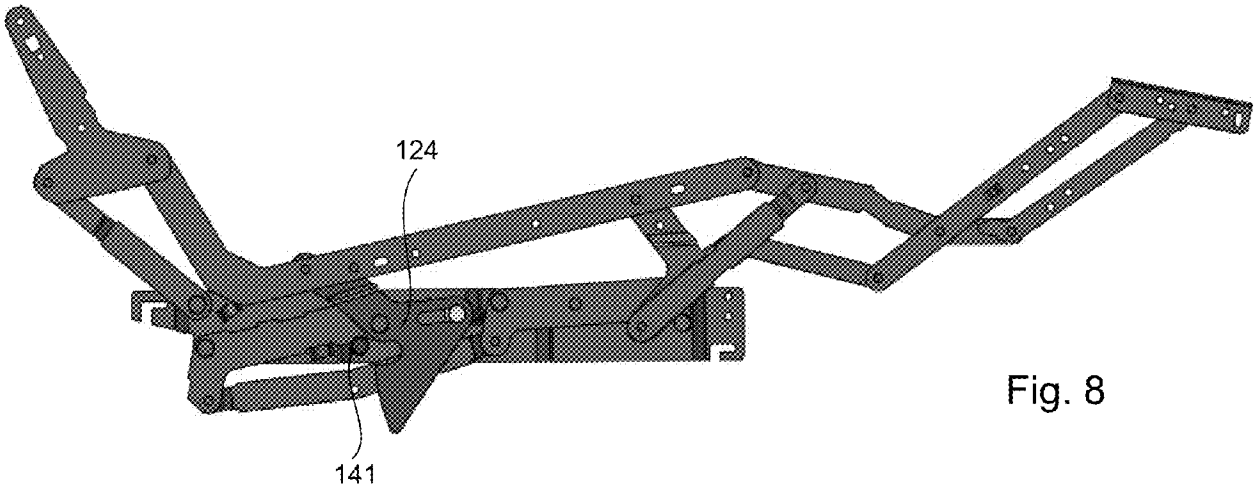
FIG. 8 shows a side view of the left chair frame in the TV position.

When the base mounting plate 120 moves to a desired position between the most rearward and forward positions, the footrest linkage is in the extended position, and the backrest mounting bracket 132 and the seat mounting link 116 define a third angle therebetween, where the third angle is greater then the first angle but less than the second angle, as shown in FIG. 8. This corresponds to a position in which the reclining chair is in the fully reclined position. No free fall of the footrest occurs in this position.

Preferably, the chair frame 100 is made from durable materials such as steel, alloy, plastic, wood, or any combination of them, as known to people skilled in the art.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A position holding mechanism used in a reclining lift chair having an upright position, a TV position and a fully reclined position, comprising:

(a) a position holding member having a triangle-shaped body and an arm extending from an apex of the triangle-shaped body, wherein the triangle-shaped body has a first side and a second side extending to the arm, a bottom extending to the first and second sides, a notched receptacle recessed from the first side proximal to the apex and an obround opening defined proximally along the second side; and wherein the arm has two openings defined in each end portion; and (b) a detent pin assembly having a stable spacer, a roller bushing received in the stable spacer, and a detent pin received in the roller bushing such that as assembled, the stable spacer is rotatable relative to the detent pin, wherein the position holding member is movably positioned in relation to the detent pin assembly such that when the reclining lift chair is in the upright position, the detent pin assembly is received in the notched receptacle of the position holding member, and when the reclining lift chair is in the fully reclined position, the detent pin assembly is against the first side of the position holding member.

2. A reclining lift chair comprising the position holding mechanism of claim 1.

3. A reclining lift chair frame used in a reclining lift chair having an upright position, a TV position, and a fully reclined position, comprising:

(a) a base mounting plate;

(b) a seat mounting link positioned movably relative to the base mounting plate;

(c) a footrest driving mechanism pivotally connected between the base mounting plate and the seat mounting link;

(d) a footrest linkage pivotally connected to the footrest driving mechanism and the seat mounting link, wherein the footrest linkage is operably driven by the footrest driving mechanism between a retracted position and an extended position;

(e) a backrest linkage pivotally connected to the seat mounting link and the base mounting plate;

(f) a rear drive linkage pivotally connected to the base mounting plate and the footrest driving mechanism, for driving the backrest linkage and the footrest driving mechanism to be in a desired position that is corresponding to one of the upright position, the TV position, and the fully reclined position of the reclining lift chair; and (g) a position holding mechanism comprising:

(i) a position holding member having a triangle-shaped body and an arm extending from an apex of the triangle-shaped body, wherein the triangle-shaped body has a first side and a second side extending to the arm, a bottom extending to the first and second sides, a notched receptacle recessed from the first side proximal to the apex and an obround opening defined proximally along the second side; wherein the arm has a first opening defined in a free end portion and a second opening defined in an end portion proximal to the apex, and wherein the position holding member is pivotally connected to the seat mounting link through the first opening and to the rear drive linkage through the second opening, respectively; and (ii) a detent pin assembly mounted onto the base mounting plate, and having a stable spacer, a roller bushing received in the stable spacer, and a detent pin received in the roller bushing such that the stable spacer is rotatable relative to the detent pin, wherein the position holding member is movably positioned in relation to the detent pin assembly such that when the reclining lift chair is in the upright position, the detent pin assembly is received in the notched receptacle of the position holding member, and when the reclining lift chair is in the fully reclined position, the detent pin assembly is against the first side of the position holding member.

4. The reclining chair frame of claim 3, wherein the footrest linkage comprises a scissor-type linkage.

5. The reclining chair frame of claim 4, wherein the footrest linkage comprises a first front link, a second front link, a first rear link, a second rear link and a footrest mounting bracket, each link having a first end portion and a second end portion, wherein the first end portions of the first and second front links are pivotally connected to the footrest mounting bracket, and the second end portions of the first and second front links are pivotally connected to the first end portions of the first and second rear links, respectively, wherein the second front link is pivotally connected to the first rear link, and wherein the second end portion of the first rear link is pivotally connected to a front end portion of the seat mounting link.

6. The reclining chair frame of claim 5, wherein the footrest driving mechanism comprises a front link, a rear link and a drive link, each link having a first end portion and a second end portion, wherein the first end portion of the front link is pivotally connected to the first rear link of the footrest linkage, the first end portion of the drive link is pivotally connected to the seat mounting link, the second end portion of the rear link is pivotally connected to the base mounting plate, and wherein the second end portions of the front and drive links, the first end portion of the rear link and the second end portion of the second rear link of the footrest linkage are pivotally connected together.

7. The reclining chair frame of claim 6, wherein the rear drive linkage comprises a stop link, a brace link and a connection link, each link having a first end portion and a second end portion, wherein the first end portion of the stop link is pivotally connected to the position holding member of the position holding mechanism through the second opening, and the second end portion of the stop link is pivotally connected to the base mounting plate, wherein the first end portion of the connection link is pivotally connected to the second end portion of the rear link of the footrest driving mechanism, and the second end portion of the connection link is pivotally connected to the second end portion of the stop link, and wherein the first end portion of the brace link is pivotally connected to the position holding member of the position holding mechanism through the obround opening, and the second end portion of the brace link is pivotally connected to the base mounting plate.

8. The reclining chair frame of claim 7, wherein the brace link is operably movable back and forth along the obround opening of the position holding member of the position holding mechanism.

9. The reclining chair frame of claim 7, wherein the backrest linkage comprises a backrest link having a first end portion and a second end portion pivotally connected to the base mounting plate, and a backrest mounting bracket pivotally connected to the second end portion of the backrest link and a rear end portion of the seat mounting link.

10. The reclining chair frame of claim 9, wherein when the base mounting plate moves, relative to the seat mounting link, to a most rearward position, the footrest linkage is in the retracted position, the detent pin assembly is received in the notched receptacle of the position holding member of the position holding mechanism, and the backrest mounting bracket and the seat mounting link define a first angle therebetween, which corresponds to a position in which the reclining chair is in the upright position.

11. The reclining chair frame of claim 10, wherein when the base mounting plate moves, relative to the seat mounting link, to a most forward position, the footrest linkage is in the extended position, the detent pin assembly is positioned against the first side of the position holding member of the position holding mechanism, and the backrest mounting bracket and the seat mounting link define a second angle therebetween, wherein the second angle is greater then the first angle, which corresponds to a position in which the reclining chair is in the fully reclined position.

12. The reclining chair frame of claim 11, wherein when the base mounting plate moves, relative to the seat mounting link, to a desired position between the most rearward and forward positions, and the backrest mounting bracket and the seat mounting link define a third angle therebetween, wherein the third angle is greater then the first angle but less than the second angle, which corresponds to a position in which the reclining chair is in the fully reclined position.

13. A reclining lift chair comprising the reclining lift chair frame of claim 3.

* * * * *